US005671884A

United States Patent [19]

Restive

[11] Patent Number: 5,671,884

[45] Date of Patent: Sep. 30, 1997

[54] BACKPACK SPRAYER WITH AN EXPANDABLE ACCUMULATOR CHAMBER

[75] Inventor: Mario John Restive, Frankfort, N.Y.

[73] Assignee: D.B. Smith & Co., Inc., New York Mills, N.Y.

[21] Appl. No.: 509,149

[22] Filed: Jul. 31, 1995

[51] Int. Cl.[6] ..... B05B 9/08

[52] U.S. Cl. ..... 239/154; 239/373

[58] Field of Search ..... 239/152–154, 239/373, 320, 321, 323, 327, 331; 222/386.5

[56] References Cited

U.S. PATENT DOCUMENTS

| | | | |
|---|---|---|---|
| 1,297,865 | 3/1919 | Kirkwood . | |
| 1,520,502 | 12/1924 | Lundblad . | |
| 1,902,548 | 3/1933 | Fenwick, Jr. . | |
| 2,162,057 | 6/1939 | Brandt et al. | 299/97 |
| 2,545,319 | 3/1951 | Sundholm | 222/256 |
| 2,653,848 | 9/1953 | Lee . | |
| 3,123,254 | 3/1964 | Rabbyet et al. . | |
| 3,452,905 | 7/1969 | Micallef . | |
| 3,519,167 | 7/1970 | Rast . | |
| 3,746,261 | 7/1973 | Nozawa et al. . | |
| 3,767,078 | 10/1973 | Gortz et al. . | |
| 3,995,774 | 12/1976 | Cooprider et al. . | |
| 4,142,653 | 3/1979 | Masciaet et al. . | |
| 4,167,941 | 9/1979 | Capra et al. . | |
| 4,222,500 | 9/1980 | Capra et al. . | |
| 4,241,853 | 12/1980 | Pauls et al. | 222/207 |
| 4,251,032 | 2/1981 | Werding | 239/323 |
| 4,324,350 | 4/1982 | Thompson . | |
| 4,419,096 | 12/1983 | Leeper et al. | 604/132 |
| 4,423,829 | 1/1984 | Katz . | |
| 4,735,239 | 4/1988 | Salmon et al. | 141/25 |
| 4,787,560 | 11/1988 | DeYoreo . | |
| 4,867,208 | 9/1989 | Fitzgerald et al. . | |
| 4,875,508 | 10/1989 | Burke, II et al. . | |
| 4,953,753 | 9/1990 | Gortz . | |
| 4,955,512 | 9/1990 | Sharples | 222/386.5 |
| 5,080,652 | 1/1992 | Sancoff et al. | 604/132 |
| 5,105,983 | 4/1992 | Sancoff et al. | 222/103 |
| 5,111,971 | 5/1992 | Winer . | |
| 5,127,554 | 7/1992 | Loychuk | 222/183 |
| 5,137,175 | 8/1992 | Kowalski et al. | 222/1 |
| 5,167,631 | 12/1992 | Thompson et al. | 604/132 |
| 5,180,085 | 1/1993 | Schmid | 222/211 |
| 5,183,185 | 2/1993 | Hutcheson et al. . | |
| 5,187,498 | 2/1993 | Burger . | |
| 5,240,151 | 8/1993 | Worm . | |
| 5,303,853 | 4/1994 | Nye . | |
| 5,335,853 | 8/1994 | Wirz | 239/142 |

OTHER PUBLICATIONS

A Brochure of D.B. Smith & Co., Inc.'s Field King Backpack Sprayer—Royal Treatment For Roundup No date.

*Primary Examiner*—Lesley D. Morris
*Attorney, Agent, or Firm*—Bond, Schoeneck & King LLP

[57] ABSTRACT

An improved backpack sprayer, comprising a supply tank, an expandable accumulator, a pump mechanism, an intake valve, a discharge valve, and a spray wand with a nozzle. The expandable accumulator is preferably an elastomeric bladder, the function of which is to accumulate fluid from the supply tank under pressure. The volume of the bladder expands as pressurized fluid enters from the pump mechanism. As with most backpack sprayers, the pump mechanism is positioned adjacent to the bottom of the supply tank and is in fluid communication with the tank. The function of the pump mechanism is to pump fluid from the supply tank into the bladder. An intake valve, associated with an inlet opening of the bladder, enables a unidirectional flow of liquid from the pump to the bladder. Discharge of fluid from the bladder also occurs through the inlet opening upon the opening of a discharge valve. The discharge valve is normally closed to permit the bladder to accumulate a desired quantity of fluid. In the preferred embodiment, the discharge valve is hand-operated and located in a handle attached to a spray wand and nozzle. When the discharge valve is opened, the discharged fluid is directed from the accumulator and channeled through a hose, trigger handle, spray wand and spray nozzle.

20 Claims, 6 Drawing Sheets

BACKPACK SPRAYER WITH AN EXPANDABLE ACCUMULATOR CHAMBER

BACKGROUND OF THE INVENTION

1. Technical Field

The present invention relates generally to sprayer apparatus, and, more particularly to backpack or knapsack sprayers employing a pressure vessel or accumulator to produce a pressure source for discharging fluid at the spray nozzle.

2. Background Art

A conventional backpack sprayer includes a supply tank which is normally dimensioned to hold between two and five gallons of liquid, a manual lever pump, a pressure vessel or accumulator, a manual shut-off valve, and a spray wand with a nozzle. In operation, the pump draws discharge liquid from the supply tank and pumps it into the accumulator. Initially, the accumulator contains air at atmospheric pressure. As liquid is pumped into the accumulator, normally from its bottom, the air inside is compressed at the top of the vessel. The compressed air acts as a spring on the liquid and provides a pressure source for discharging the liquid. Once the liquid is discharged from the accumulator it is directed to a spray nozzle to effectuate a desired spray pattern. An example of a conventional backpack sprayer is one manufactured by D. B. Smith & Co., Inc., Utica, N.Y., under the brand name of FIELD KING® In addition, conventional backpack sprayers are described in U.S. Pat. No. 5,335,853 to Wirz and U.S. Pat. No. 2,162,057 to Brandt et al.

In the operation of a conventional pressure vessel or accumulator, energy is stored in the compressed air until the liquid is allowed to be discharged from the accumulator. This method of storing energy is very inefficient because the air is heated when it is compressed. This heat is energy lost that cannot be recovered. The efficiency of the accumulator directly affects the utility of the sprayer. As the efficiency of the accumulator increases, the number of pump strokes necessary to produce a desired discharge pressure is decreased. Thus, an inefficient accumulator relates to operator fatigue and reduces the utility of the sprayer for many applications.

In a conventional compressed-air accumulator, the pressure exerted on the liquid does not remain constant as the volume of the liquid in the accumulator changes. This characteristic creates several problems. First, a higher accumulator pressure is required to achieve a given spray duration than would be necessary if the pressure source were constant. The higher the pressure, the more inefficient a fixed volume accumulator becomes. Thus, for long duration spray applications, the conventional backpack sprayer becomes very inefficient.

Second, a fixed volume accumulator produces a continuously decreasing discharge pressure as the liquid therein is being expelled. This results in non-uniform application of the liquid being sprayed. This performance is especially undesirable when chemicals, such as insecticides, herbicides or fungicides, are being sprayed. In many cases, non-uniform application leads to reapplication, and thus overuse and waste of the chemicals being sprayed.

Third, when the application requires a constant spray rate, a pressure regulator must be used with a conventional backpack sprayer. This component is relatively expensive considering the overall cost of a conventional backpack sprayer. The pressure regulator also reduces the efficiency of the sprayer.

All of these problems that are associated with a conventional backpack sprayers have existed for nearly (100) hundred years. Heretofore, no satisfactory solution to these problems have been proposed. The present invention has finally solved these long standing problems, and has accomplished this achievement by a simple and inexpensive modification to the conventional backpack sprayer design.

SUMMARY OF THE INVENTION

It is therefore an object of the present invention to provide a backpack sprayer that avoids the problems associated with the prior art.

It is another object of the present invention to provide a backpack sprayer with improved efficiency of operation.

It is a further object of the present invention to provide a backpack sprayer that supplies a substantially constant pressure source for the liquid to be sprayed.

It is yet another object of the present invention to provide a backpack sprayer that produces a more uniform spray application over a longer spray duration than conventional backpack sprayers.

It is yet a further object of the present invention to provide a backpack sprayer which reduces the need for reapplication and minimizes waste of the liquid to be sprayed. It is still another object of the present invention to provide a backpack sprayer that does not require a pressure regulator for constant pressure spray applications.

It is still a further object of the present invention to provide a backpack sprayer that requires less manual work to operate than conventional backpack sprayers.

It is still yet another object of the present invention to provide a backpack sprayer which can be easily converted between a sprayer of the present invention and a conventional sprayer.

It is still yet a further object of the present invention to provide a backpack sprayer with an expandable accumulator that can be easily replaced with another accumulator to change the discharge pressure rating of the sprayer.

It is still yet a further object of the present invention to provide a backpack sprayer having an expandable accumulator which contains indicia, such as color-coding, to identify the discharge pressure rating of the accumulator.

These and other objects are obtained in accordance with the present invention wherein there is provided a backpack sprayer comprising a supply tank, an expandable accumulator, a pump mechanism, an intake valve, and a discharge valve. The supply tank is designed to hold a specific quantity of application fluid, such as an insecticide, herbicide or fungicide composition, or a water sealant for concrete or wood. The supply tank is configured and dimensioned to be comfortably supported on the back of an individual operator using shoulder straps. The expandable accumulator is preferably an elastomeric bladder. The function of the expandable accumulator is to accumulate the application fluid under pressure as its volume expands from an initial volume to an expanded volume.

As the volume of the elastomeric bladder expands from an initial volume to an expanded volume (when pressurized application fluid enters from the pump mechanism), energy is being stored in the elastic of the bladder. The energy is returned to the liquid when the liquid is discharged from the bladder. As the liquid is discharged, the bladder's volume contracts from the expanded volume to its initial volume. A bladder accumulator stores and transfers energy very efficiently because of the elastic properties of the bladder.

Another important property of the bladder accumulator is that it will hold a constant pressure as its volume expands. This property provides the sprayer of the present invention with a substantially constant pressure source, and eliminates the need for a pressure regulator for constant pressure applications.

As with most backpack sprayers, the pump assembly is positioned adjacent to the bottom of the supply tank and is in fluid communication with the supply tank. The pump assembly may be located either inside or outside the supply tank, near the bottom of the tank. The function of the pump assembly is to pump liquid from the supply tank into the expandable accumulator or bladder. An intake valve, associated with an inlet opening contained in the expandable accumulator, enables a unidirectional flow of liquid from the pump assembly to the expandable accumulator through the inlet opening.

Discharge of fluid from the expandable accumulator also occurs through the inlet opening. This fluid discharge is controlled by a discharge or shutoff valve which normally operates to either open or close the path of fluid discharge. The discharge valve is normally closed to permit the expandable accumulator to accumulate a desired quantity of fluid under pressure. When the discharge valve is opened, the fluid is discharged from the accumulator. In the preferred embodiment, the discharge valve is hand-operated and located in a handle attached to a spray wand and nozzle. When the discharge valve is opened, the discharged fluid is directed from the accumulator and channeled through a hose, trigger handle, spray wand and spray nozzle.

In the preferred embodiment, the expandable accumulator is an elastomeric bladder. The bladder can be characterized by a specific pressure rating, which represents the pressure, in pounds per square inch (psi), that the bladder will hold fluid under normal bladder volume requirements. This pressure rating is made known to the operator by some indicia contained on the bladder. The preferred indicia is a uniquely assigned color for each specified rating, i.e., color-coding.

In the preferred embodiment, the bladder accumulator is designed to be easily replaced with another accumulator having the same or a different pressure rating. This enables the operator to easily change the application pressure of the sprayer. The bladder accumulators of the present invention are configured with the same fitting so that one can be replaced with another in the sprayer. The accumulator fitting is made identical to the fitting of a conventional fixed-volume accumulator used for the sprayer. Thus, the backpack sprayer can be easily converted between conventional fixed-volume operation and the expandable volume operation of the present invention. For example, the sprayer can be converted to fixed-volume operation for high pressure spray applications, and to expandable-volume operation for constant pressure applications.

In the preferred embodiment, the bladder accumulator is enclosed within a fixed-volume housing for containing the bladder and operating as an upper limit to bladder volume expansion. The housing also functions as a safety guard in the event that the bladder explodes. The housing contains at least one purging hole to allow equalization of fluid pressure between the interior and exterior of the housing. In the preferred embodiment, the housing contains four pairs of purging holes, equally spaced around its circumference.

BRIEF DESCRIPTION OF THE DRAWING

Further objects of the present invention will become apparent from the following description of the preferred embodiments with reference to the accompanying drawings, in which.

DESCRIPTION OF THE PREFERRED EMBODIMENT

Figure 1:
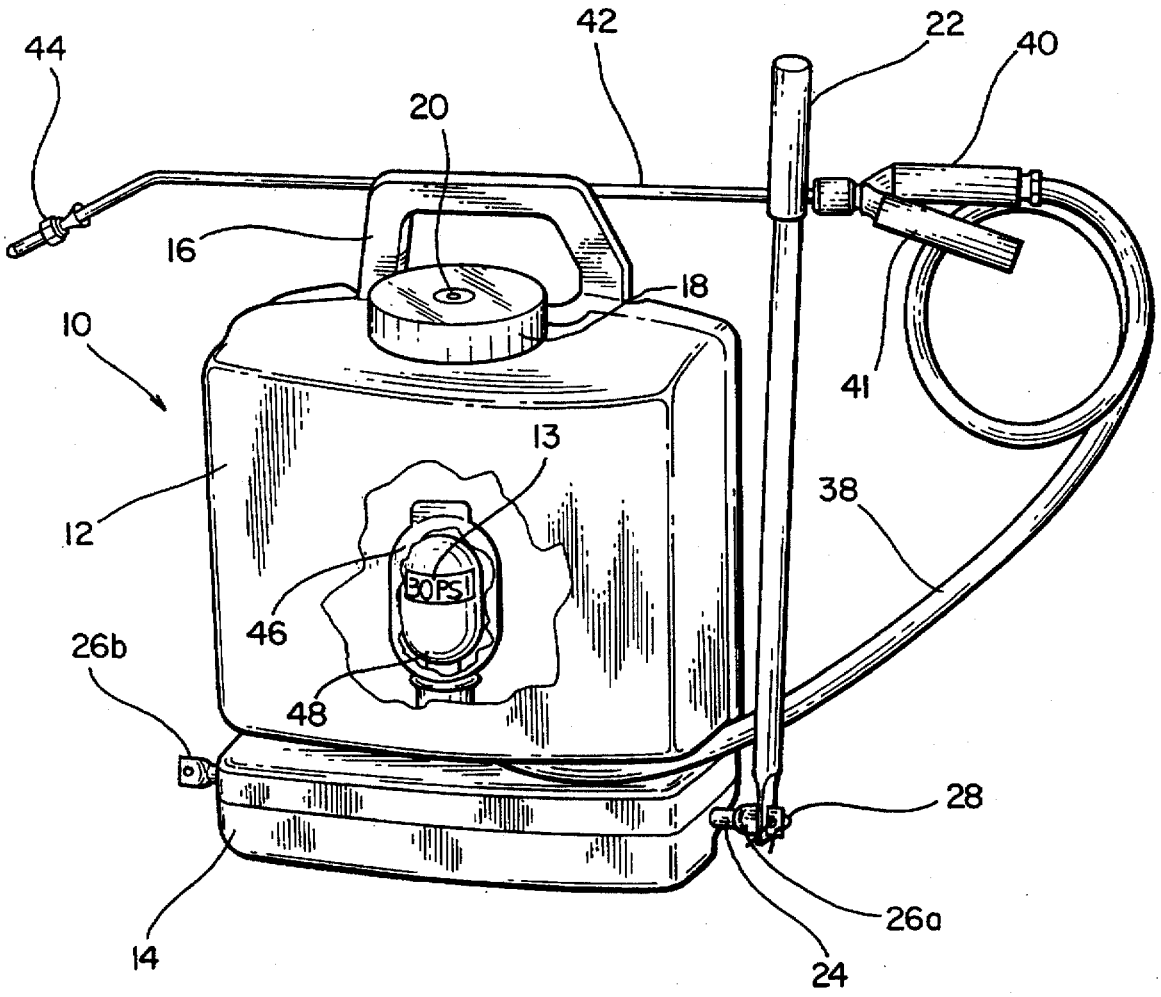
FIG. 1 is a frontal perspective view of a backpack sprayer (without shoulder straps or lumbar support) embodying the teachings of the present invention.

Referring to FIG. 1 of the drawing, there is shown a backpack sprayer 10 configured in accordance with the present invention. Sprayer 10 includes a supply tank 12 which is constructed of a chemically resistant material such as polyethylene or stainless steel. In the embodiment shown, tank 12 is constructed of polyethylene. Backpack sprayers are normally used to apply insecticides, herbicides, fungicides, pesticides, water sealants and other chemical compositions. Therefore, tank 12 must be inert to such compositions. Typically, tank 12 is dimensioned to hold between two and five gallons of liquid.

Sprayer 10 further includes a base 14, also made of polyethylene. Base 14 is fastened to the bottom of supply tank 12 by a pair of screws. A tank carrying handle 16 is mounted to the rear side of tank 12 by four screws (not shown). Tank 12 contains a fill opening in its top wall which is covered by a cover 18. Surrounding the fill opening is a rim to which cover 18 is secured by a camlock arrangement. Cover 18 has a flat sealing ring or gasket (not shown) which bears down on the rim of the fill opening to ensure a liquid tight seal when the cover is secured to the rim. Cover 18 contains a pressure equalization valve 20 which functions to equalize the pressure between the interior of tank 12 and atmospheric pressure. As represented in FIG. 1, valve 20 is configured as an umbrella or flapper valve which is forced open when a predetermined level of negative pressure is established inside tank 12.

Figure 2:
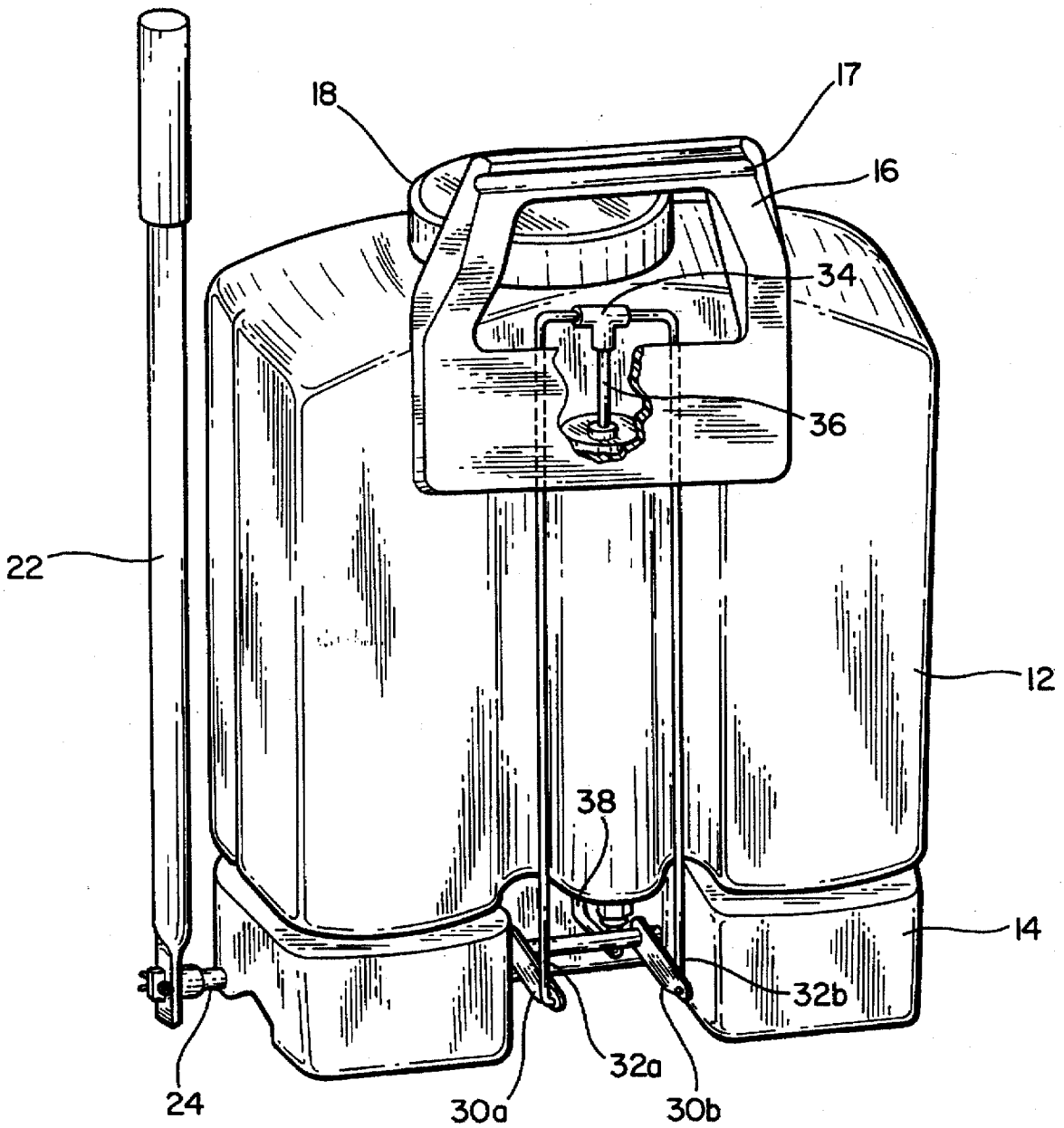
FIG. 2 is a rear perspective view of the backpack sprayer of FIG. 1.

As shown in FIGS. 1 and 2, sprayer 10 includes a manual lever pump handle 22 which is mounted to a rotatable crank shaft 24. Handle 22 may be mounted either on the right or left side of tank 12. Handle 22 contains a mounting slot at its end (not shown) through which end 26*a,b* fits. A cotter pin 28 is inserted through a hole contained in end 26*a,b* to retain handle 22 on end 26.

As shown in FIG. 2, a bell crank pair 30*a*, 30*b* is fixedly mounted to crank shaft 24. A pair of tie rods 32*a* and 32*b* are pivotally mounted to the ends of bell crank pair 30*a* and 30*b* respectively. Tie rods 32*a* and 32*b* extend upward along the rear of tank 12 and terminate inside a T-coupling 34. Tie rods 32*a* and 32*b* may be fashioned from a single rod which is shaped and mounted as shown in FIG. 2. A piston rod 36 is inserted into the tail portion of T-coupling 34 as shown in FIG. 2. Piston rod 36 forms part of a reciprocating pump contained in supply tank 12 (see FIG. 3).

With further reference to FIG. 1, there is shown a discharge hose 38 which functions as the output from tank 12 as will be understood from the description to follow. Hose 38 is a chemically resistant, reinforced hose. A trigger handle 40 is connected to the distal end of hose 38. Handle 40 contains an in-line polyethylene screen filter (not shown) and a trigger actuated discharge or shut-off valve (See FIG. 3, ref. 110). The details of handle 40 are well known to one of ordinary skill in the art and are commercially available. For example, D. B. Smith & Co., Inc. of Utica, N.Y., manufacturers a number of backpack and compressed air sprayers containing such a handle. Handle 40 contains a palm-activated trigger 41 which actuates the discharge valve from a normally closed position to an open position by squeezing trigger 41 and handle 40 together. A brass tube or spray wand 42 is connected at its proximal end by a threaded fitting to handle 40. An adjustable brass spray nozzle 44 is mounted to the distal end of wand 42 by a threaded coupling. Nozzle 44 is preferably a low pressure nozzle having a pressure rating of 20 psi and a flow rate of 0.2 gallons per minute. Hose 38, handle 40, spray wand 42, and nozzle 44 together establish a fluid discharge channel for sprayer 10.

With further reference to FIG. 1, the improvement of the supply tank 12 reveals a generally cylindrical polyethylene housing 46 which is, in turn, cut away to show an elastomeric bladder accumulator 48. Housing 46 and bladder 48 have replaced the conventional fixed-volume accumulator. Note that bladder 48 contains indicia 13 which identifies the accumulator pressure rating for bladder 48. This indicia may simply be a color uniquely assigned to a given pressure rating. In the preferred embodiment, bladder 48 is made of Buna-N® synthetic rubber.

The pumping operation of sprayer 10 begins with handle 22. As understood from FIGS. 1 and 2, handle 22 is rotated forward (out of the paper) causing crank shaft 24 to rotate. Rotating shaft 24, in turn, forces bell crank pair 30*a*, 30*b* downward, causing tie rods 32*a* and 32*b* to travel downward. The downward motion of rods 32*a* and 32*b* cause piston rod 36 to travel downward to effectuate a downward stroke of the pump, located in supply tank 12.

Figure 3:
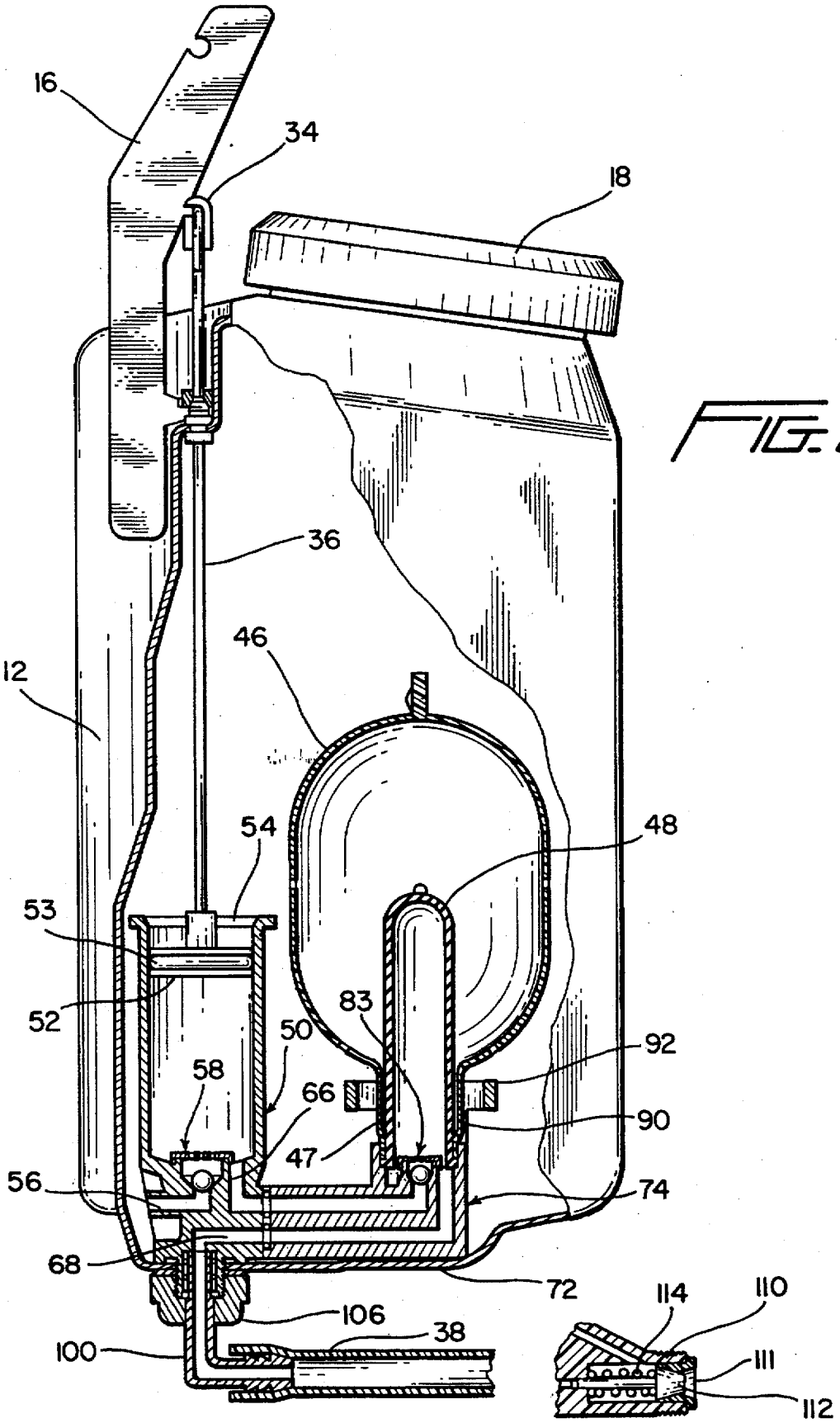
FIG. 3 is a partial cross sectional view of the backpack sprayer of FIG. 1.

Referring now to FIG. 3, there is shown a partial sectional view of the internal components of sprayer 10. A pump assembly 50 comprises a piston 52 which is connected to piston rod 36. Piston 52 is preferably a polyethylene disc containing a circumferentially spaced grove for holding an O-ring 53. Piston 52 is dimensioned for a close sliding fit with the internal wall of a piston cylinder 54. Piston 52 slidably engages cylinder 54 in a reciprocating (up and down) motion. The reciprocating motion of piston 52 is achieved by the forward and reverse motion of handle 22.

Figure 4:
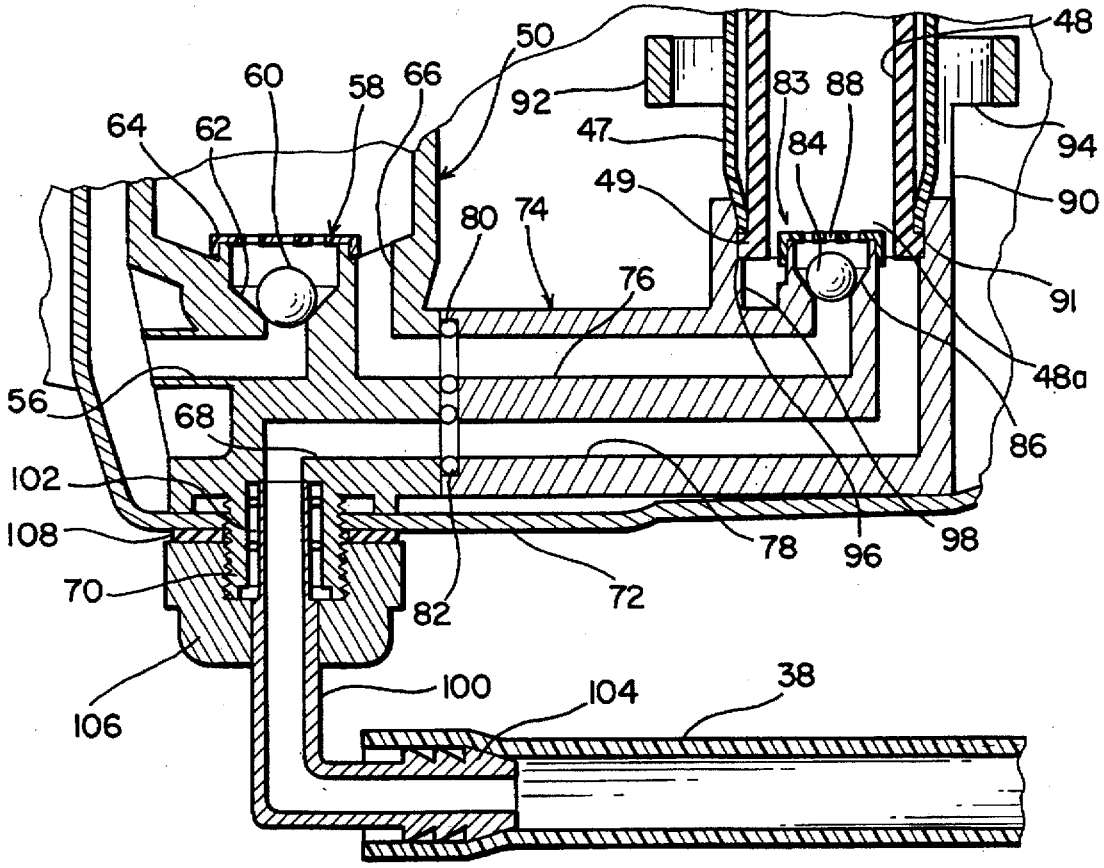
FIG. 4 is an enlarged cross sectional view of certain internal components of the backpack sprayer of FIG. 1.

As shown in FIGS. 3 and 4, pump assembly 50 contains a draw channel 56 which establishes fluid communication between the interior of supply tank 12 and the interior of piston cylinder 54. Channel 56 terminates, inside cylinder 54, at an intake valve 58. As shown in FIG. 4, intake valve 58 is configured as a check valve which includes a check ball 60, a valve seat 62 and a check cap 64. Cap 64 contains a centrally located hole having a diameter less than the diameter of check ball 60 to retain ball 60. In addition, four smaller holes are equally spaced and contained in cap 64 to permit fluid flow into cylinder 54. The operation of valve 58 is conventional and will not be further described herein.

As shown in FIGS. 3 and 4, pump assembly 50 further contains an outlet channel 66 which communicates directly with the bottom portion of cylinder 54. An output channel 68 is also contained in pump assembly 50, and its function will be described herein below. At the bottom of pump assembly 50 there is a cylindrically-shaped threaded fitting which extends through a bottom wall 72 of tank 12, as best shown in FIG. 4.

A manifold 74 is attached to pump assembly 50 by two screws (not shown). Manifold 74 contains an intake channel 76 and an outlet channel 78, as shown in FIG. 4. At the union of pump assembly 50 and manifold 74, there is a pair of O-rings 80 and 82. O-ring 80 ensures a sealed connection between channel 66 and channel 76. O-ring 82 ensures a sealed connection between channel 68 and channel 74. Manifold 78 also contains an intake valve 83 configured as a check valve, having a check ball 84, a valve seat 86, and a check cap 88. The configuration of cap 88 is identical to cap 64 described above. Valve 83 permits only a unidirectional flow of fluid from channel 76 into the interior volume of bladder 48, by way of an inlet opening 48*a* (See FIG. 4).

Figure 7:
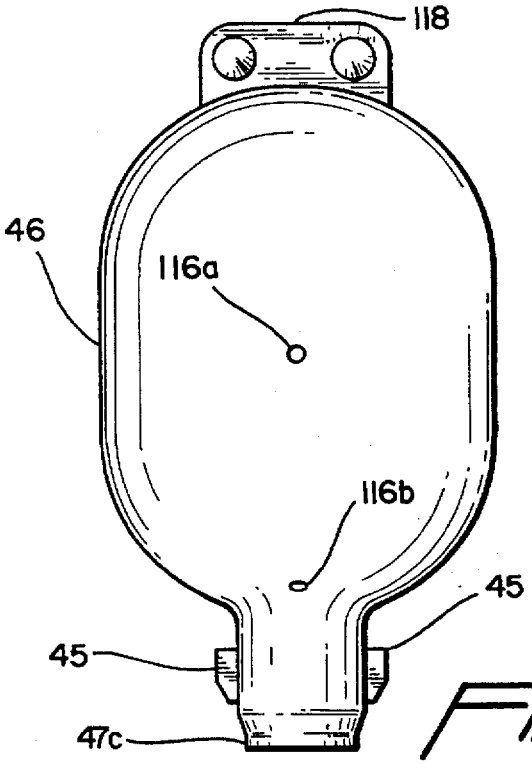
FIG. 7 is a front elevational view of the bladder housing of FIG. 6.

With further referenced to FIG. 4, manifold 74 includes a keyed coupling portion 90 which is configured and dimensioned to receive a stem portion 47 of housing 46. Coupling portion 90 includes a keyed flange 92 and a cam locking surface 94. Flange 92 permits the insertion of housing 46 and expandable accumulator 48 into coupling 90 in a predetermined orientation. A top plan view of coupling 90 is shown in FIG. 8A. Housing 46 contains a pair of key elements 45 which are configured and dimensioned to mate with flange 92 (See FIGS. 7 and 8). The assembly of housing 46 and bladder 48 is coupled to manifold 74 by inserting stem 47 through flange 92 and into coupling 90, and turning the entire assembly 90°. Key elements 45 engage cam surfaces 94 when housing 46 is rotated 90° from the keyed orientation.

As shown in FIG. 4, a sealing flange 49 of bladder 48 is placed in a close sealing fit with the rim of stem 47, a surrounding wall 91 of coupling 90, and a shoulder 96 of coupling 90. Flange 49 is designed to function as a hydraulic seal and to resist movement once in place in coupling 90. As bladder 48 expands with pressurized fluid, flange 49 is pulled up against the rim of stem 47 and out against surrounding wall 91 to reinforce the seal between flange 49 and coupling 90 (See FIG. 4). An annular channel 98 is established between flange 49 and an annular floor of manifold 74 which surrounds valve 83. Annular channel 98 communicates with outlet channel 78. There is fluid communication between the interior volume of bladder 48 and annular channel 98 through inlet opening 48*a*, as understood from FIG. 4. Fluid discharged from bladder 48 would first pass through channel 98 and then to channel 78.

As shown in FIG. 4, an L-shaped fitting 100 has a pump end 102 containing a pair of O-ring groves which hold a pair of O-rings. A tight sealing fit is established with end 102 inside the bore contained in threaded fitting 70. Fitting 100 also has a hose end 104, configured and dimensioned to mate tightly with the interior wall of hose 38. Hose 38 may be secured to end 104 by use of a hose clamp (not shown). As shown in FIG. 4, pump assembly 50 is clamped to bottom wall 72 by threading a nut 106 onto fitting 70. A liquid tight seal is established at this connection by use of a sealing ring or gasket 108.

Referring back to FIG. 3, a discharge or shut-off valve 110 is represented. As mentioned earlier, shut-off valve 110 is housed within handle 40 of sprayer 10. Valve 110 contains an outlet port 111 and includes a check head 112. As is well known in the sprayer art, valve 110 is designed to be normally in a closed position, and this is accomplished here by a compression spring 114 urging check head 112 against a stop. Trigger handle 41 operates to pull check head 112 back against spring 114 to open valve 110.

Figure 5A:
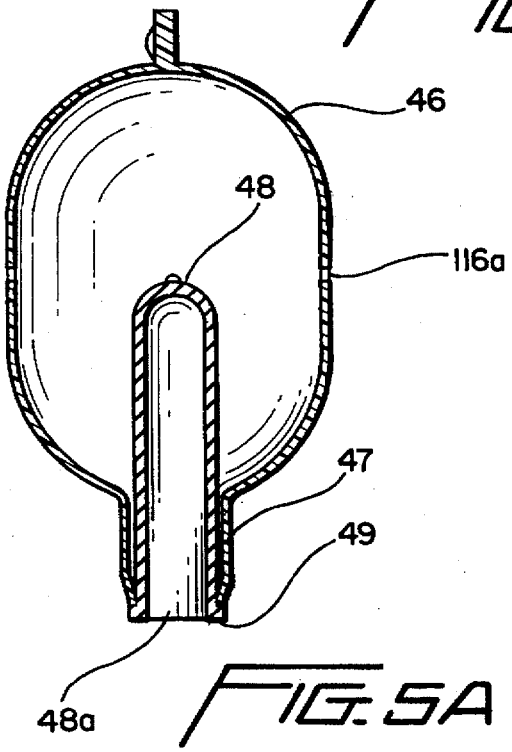
FIGS. 5A and 5B are cross sectional views of a bladder accumulator and bladder housing constructed in accordance with the present invention, illustrating the accumulator's initial volume and expanded volume respectively.
Figure 5B:
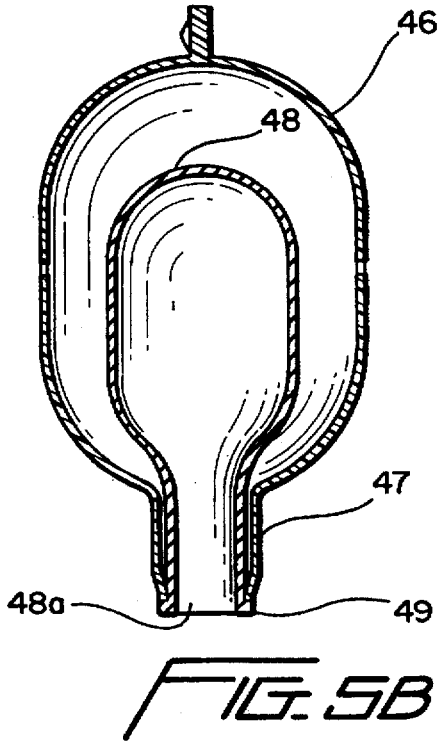

Referring now to FIGS. 5A and 5B, there is shown sectional views of bladder 48 contained in housing 46. FIG. 5A shows bladder 48 in its initial volume state, and FIG. 5B shows bladder 48 in its expanded volume state.

Referring now to FIGS. 6, 6A, 7 and 7A, the details of construction of housing 46 is shown. As seen from FIGS. 6 and 7, housing 46 contains several pairs of purging holes 116*a*, 116*b*. In the preferred embodiment, four holes 116*b* are equally spaced around the bottom of housing 46, as shown, and only one hole 116*a* is located at the mid-section of housing 46. The diameter of purging holes 116*a* and 116*b* is ⅛ of an inch. The diameter may be as large as ¼ of an inch. The function of holes 116*a*, 116*b* are to equalize the fluid pressure between the interior and exterior of housing 46 during operation of sprayer 10. Key elements 45 are configured and dimensioned to mate with keyed flange 92 of manifold 74. Housing 46 also includes a finger grip 118 which facilitates manual insertion of housing 46 into coupling 90. Housing 46 is constructed of polyethylene.

Figure 6:
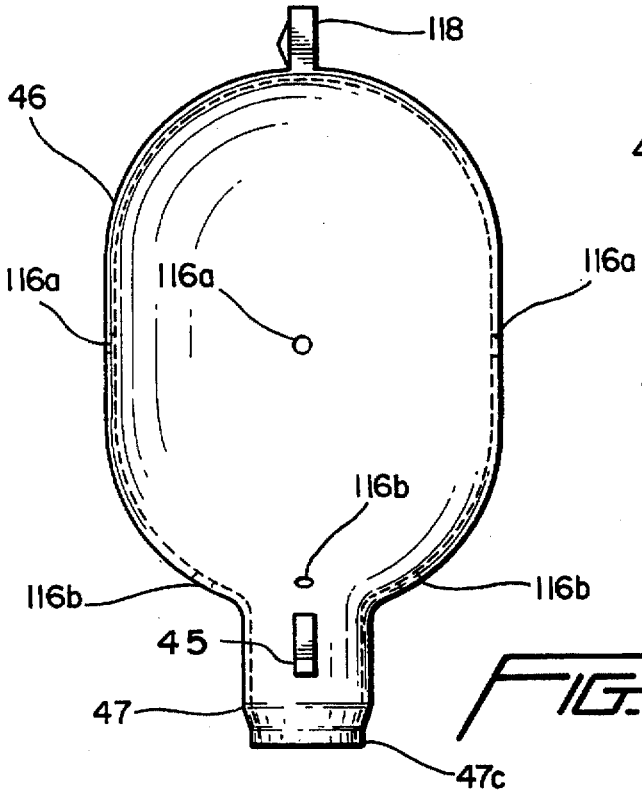
FIG. 6 is a side elevation view of a bladder housing constructed in accordance with the present invention.
Figure 6A:
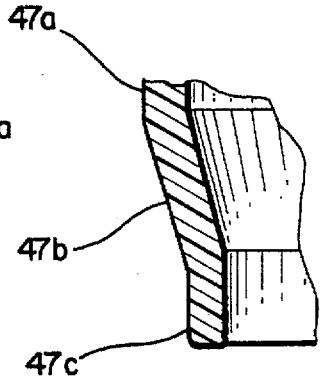
FIG. 6A is an enlarged fragmented, sectional view of the stem portion of the bladder housing of FIG. 6.
Figure 7A:
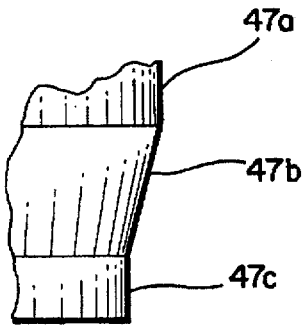
FIG. 7A is an enlarged fragmented, elevational view of the stem portion of the bladder housing of FIG. 6.

FIG. 6A shows an enlarged fragmented, sectional view of the distal end of stem 47. This end includes a stepped reduction in diameter between stem portion 47*a*, a transition portion 47*b*, and a rim portion 47*c*. FIG. 7A shows an enlarged fragmented, elevational view of the distal end of stem 47, with stem portion 47*a*, transition portion 47*b*, and rim portion 47*c* called out.

Figure 8:
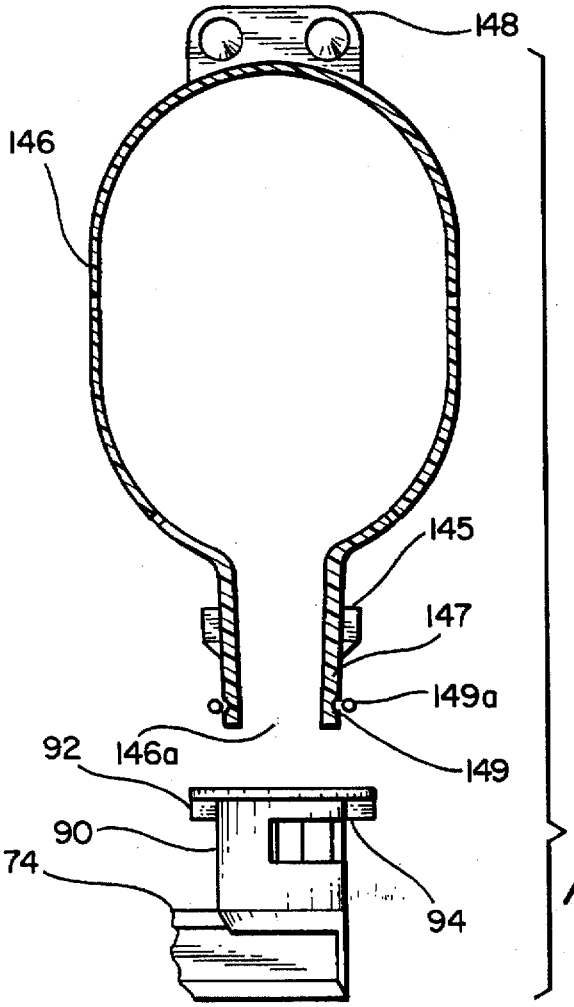
FIG. 8 is a sectional view of a conventional fixed-volume accumulator and an elevational view of a coupling portion of the backpack sprayer in which the accumulator is to be inserted.
Figure 8A:
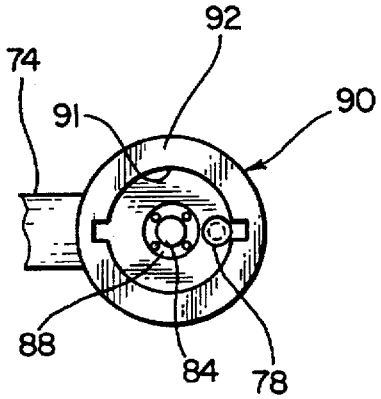
FIG. 8A is a top plan view of the coupling portion of FIG. 8.

FIG. 8 illustrates, in sectional view, a conventional fixed-volume accumulator 146 containing an inlet bore 146*a* and including a stem 147. Accumulator 146 is similar to housing 46 except that it contains no purging holes. In addition, stem 147 is longer than stem 47 of housing 46. Also, stem 147 contains an O-ring groove 149 and an O-ring 149*a* to establish a seal between accumulator 146 and coupling 90.

As shown in FIG. 8, accumulator 146 includes a pair of key elements 145 and a finger grip 148. Stem 147 is configured and dimensioned to be in sealing engagement with manifold 74. Thus, accumulator 146 mates with coupling 90 in the same manner as housing 46. This permits easy conversion between conventional operation and constant pressure operation offered by the expandable accumulator of the present invention. Conversion is easily accomplished by removing accumulator 146 from manifold 74 and replacing it with accumulator assembly 46 and 48.

If desired, conventional accumulator 146 can be converted to a bladder housing, like housing 46, by enlarging inlet bore 146*a* to accommodate a bladder (and bladder expansion) and to make the bore more uniform. In addition, stem 147 is shortened by cutting it at O-ring groove 149. To complete the conversion, at least one purging hole is put through the wall of accumulator 146.

FIG. 8A is a top plan view of coupling 90, showing keyed flange 92, surrounding wall 91, outlet channel 78, check ball 84, and check cap 88.

Figure 9:
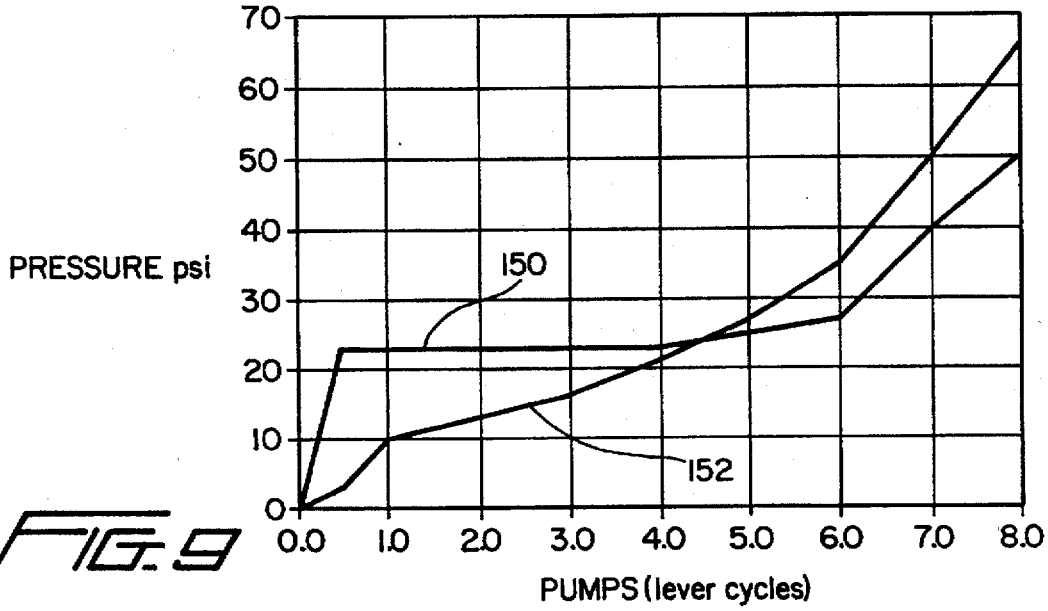
FIG. 9 is a graph showing plots of accumulator pressure versus the number of pump cycles for a bladder accumulator and a fixed-volume accumulator.

FIG. 9 is a graph showing plots of accumulator pressure versus the number of pump strokes for a bladder accumulator and a conventional fixed-volume accumulator. A curve 150 represents expandable bladder 48 and curve 152 represents fixed-volume accumulator 146. Curve 150 demonstrates that expandable accumulator 48 holds a very constant pressure as its volume is increased over a useful range (here, volume is expressed in terms of number of pump strokes). This property of expandable accumulator 48 provides sprayer 10 with a constant pressure source and eliminates the requirement for a pressure regulator for constant pressure applications.

Bladder 48 can be easily removed from housing 46 and replaced with an assortment of other accumulator bladders having different pressure ratings. In carrying out the present invention, the bladders may be color-coded to indicate to the operator different pressure ratings. For example, pressure increments of 10, 20 and 30 psi can be indicated by the colors red, blue and green.

Tests and analyses have demonstrated that it takes approximately 45 percent less manual labor to operate sprayer 10, constructed in accordance with the present invention, than a conventional backpack sprayer. Tests and analyses have also shown that less pressure is needed to ensure a constant flow rate in sprayer 10 than in a conventional backpack sprayer.

While the preferred embodiments of the invention have been particularly described in the specification and illustrated in the drawings, it should be understood that the invention is not so limited. Many modifications, equivalents and adaptations of the invention will become apparent to those skilled in the art without departing from the spirit and scope of the invention, as defined in the appended claims.

What is claimed is:

1. An improved backpack sprayer in which a supply tank is configured and dimensioned to be mounted on the back of an operator, and in which a pump assembly is located adjacent to a bottom of said tank and is in fluid communication therewith, said pump assembly being operable to pump a fluid from said tank into an accumulator through an inlet opening in said accumulator, and in which a discharge valve is associated with the inlet opening and is operable to release the fluid from said accumulator through the inlet opening for discharge through a spray nozzle, wherein the improvement comprises:

expandable accumulator means constituting said accumulator, in fluid communication with said pump assembly and having an expandable volume, for accumulating fluid under pressure as its volume expands from an initial volume to an expanded volume, and for discharging said fluid under pressure upon the opening of said discharge valve.

2. The sprayer as recited in claim 1, wherein said accumulator means is an elastomeric bladder.

3. The sprayer as recited in claim 2, wherein said bladder accumulates fluid at a substantially constant pressure as its volume expands from said initial volume to said expanded volume.

4. The sprayer as recited in claim 3, further comprising a housing enclosing said bladder to define a space between the exterior surface of said bladder and the interior surface of said housing, said housing containing at least one purging hole to substantially equalize the fluid pressure between the space and a volume surrounding the exterior of said housing.

5. The sprayer as recited in claim 4, further comprising a manifold member coupled to said pump assembly and to said bladder, and wherein said pump assembly includes a manual reciprocating pump and contains an outlet channel and a discharge channel, the discharge channel being associated with said discharge valve, said manifold member containing an intake channel which is connected to the outlet channel of said pump assembly to establish fluid communication between said pump and said bladder, and further containing an outlet channel which is connected to the discharge channel of said pump assembly to establish fluid communication between the inlet opening at said bladder and said discharge valve, said manifold member including coupling means for coupling said bladder and said housing to said manifold, and valve means, associated with the intake channel, for enabling a unidirectional flow of fluid from said pump to said bladder.

6. The sprayer as recited in claim 5, further comprising:

a hose coupled to the discharge channel of said pump assembly at one end and to said discharge valve at the other end, said discharge valve containing an outlet port and being hand-actuated by a manual trigger, a spray wand coupled to the outlet port of said discharge valve at one end thereof, and a spray nozzle coupled to the other end of said spray wand.

7. A backpack sprayer apparatus comprising:

a supply tank suitable for holding a supply of fluid, and configured and dimensioned to be mounted on the back of an individual operator;

expandable accumulator means, having an expandable volume, for accumulating fluid under pressure as its volume expands from an initial volume to an expanded volume, and for discharging said fluid under pressure as its volume contracts from the expanded volume to the initial volume, said accumulator means containing an inlet opening;

pump means, positioned adjacent to the bottom of said supply tank and in fluid communication therewith, for pumping fluid from said supply tank into said expandable accumulator means through the inlet opening;

intake valve means, associated with the inlet opening of said expandable accumulator means, for enabling a unidirectional flow of fluid from said pump means to said expandable accumulator means;

discharge valve means, associated with the inlet opening of said accumulator means, for controlling the discharge of the fluid from said accumulator means.

8. The sprayer as recited in claim 7, wherein said expandable accumulator means is an elastomeric bladder.

9. The sprayer as recited in claim 8, wherein said bladder accumulates fluid at a substantially constant pressure as its volume expands from an initial volume to an expanded volume.

10. The sprayer as recited in claim 9, wherein said bladder has a predetermined pressure rating, and is removably mounted to permit replacement with another bladder having the same or a different predetermined pressure rating.

11. The sprayer as recited in claim 10, wherein said accumulator means contains indicia identifying its predetermined pressure rating.

12. The sprayer as recited in claim 11, wherein said identifying indicia is a color uniquely assigned to a given pressure rating.

13. The sprayer as recited in claim 8, further comprising a housing enclosing said bladder to define a space between the exterior surface of said bladder and the interior surface said housing, said housing containing at least one purging hole to substantially equalize the fluid pressure between the space and the volume surrounding the exterior of said housing.

14. The sprayer as recited in claim 13, wherein said pump means comprises a manually-operated reciprocating pump.

15. The sprayer as recited in claim 14, further comprising:

a hose coupled between the inlet opening of said accumulator means and said discharge valve to establish fluid communication therebetween, said discharge valve means being hand-actuated by a manual trigger and containing an outlet port, a spray wand, having first and second ends, and coupled to the outlet port of said discharge valve at said first end, and a spray nozzle coupled to said second end of said spray wand, said spray wand establishing fluid communication between the outlet port of said discharge valve and said nozzle.

16. A method of converting a conventional backpack sprayer which includes a fixed-volume accumulator having a stem and an intake bore contained in the stem, comprising the steps of:

removing said fixed volume accumulator from said sprayer; and replacing said fixed volume accumulator with an accumulator having an expandable volume.

17. The method as recited in claim 16, further comprising the step of enclosing said expandable volume accumulator within a housing containing at least one purging hole.

18. The method as recited in claim 17, wherein said housing is made from said fixed volume accumulator by performing the steps of:

putting at least one purging hole in said fixed-volume accumulator;

enlarging the intake bore of said fixed-volume accumulator; and shortening the stem of said fixed-volume accumulator.

19. A sprayer apparatus comprising:

a container for holding a supply of fluid;

accumulator means, having an expandable volume, for accumulating fluid under pressure as its volume expands from an initial volume to an expanded volume, and for discharging said fluid under pressure as its volume contracts from the expanded volume to the initial volume, said accumulator means containing an inlet opening and having a sealing flange bounding the inlet opening;

a coupling, configured and dimensioned to receive and secure said accumulator means in an operable position, said accumulator means being secured in said coupling such that the sealing flange of said accumulator means maintains a close sealing fit with said coupling;

pump means, in fluid communication with said container, for pumping fluid from said container into said accumulator means under pressure through the inlet opening, wherein the pressurized fluid accumulated in said accumulator means causes the seal between the flange and said coupling to be reinforced;

intake valve means, associated with the inlet opening of said accumulator means, for enabling a unidirectional flow of fluid from said pump means to said accumulator means;

discharge valve means, associated with the inlet opening of said accumulator means, for controlling the discharge of the fluid from said accumulator means.

20. The apparatus as recited in claim 19, wherein said sprayer apparatus is a backpack sprayer.

* * * * *